US007090511B2

(12) United States Patent
Smirra

(10) Patent No.: US 7,090,511 B2
(45) Date of Patent: Aug. 15, 2006

(54) CIRCUIT MODULE AND METHOD FOR ITS MANUFACTURE

(75) Inventor: Karl Smirra, Wasserburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/902,514

(22) Filed: Jul. 29, 2004

(65) Prior Publication Data

US 2005/0026467 A1 Feb. 3, 2005

(30) Foreign Application Priority Data

Jul. 29, 2003 (DE) ..... 103 34 629

(51) Int. Cl.
*H01R 12/00* (2006.01)

(52) U.S. Cl. ..... 439/76.1; 439/946

(58) Field of Classification Search ..... 439/76.1, 439/79, 92, 95, 676, 718, 946; 361/737
See application file for complete search history.

(56) References Cited

U.S. PATENT DOCUMENTS 3,147,402 A * 9/1964 Hochstetler ..... 361/707
3,382,414 A * 5/1968 Borner ..... 361/784
5,219,242 A 6/1993 Liaw ..... 403/380
6,793,527 B1 * 9/2004 Noro ..... 439/579

FOREIGN PATENT DOCUMENTS

| | | |
|---|---|---|
| AT | OE 336 716 | 6/1975 |
| DE | 92 13 671.0 | 12/1992 |
| DE | 197 22 602 A1 | 12/1998 |
| DE | 299 06 664 U1 | 8/1999 |
| EP | 0 918 450 A2 | 10/1998 |

* cited by examiner

*Primary Examiner*—Khiem Nguyen
(74) *Attorney, Agent, or Firm*—Baker Botts L.L.P.

(57) ABSTRACT

A circuit module (1) comprises a base plate (2) with a pivot slot (27), into which a retaining tab (26) of a cover (25) engages. The pivot joint formed by the pivot slot (27) and retaining tab (26) between base plate (2) and cover (25) makes simply assembly of the circuit module (1) possible.

8 Claims, 4 Drawing Sheets

CIRCUIT MODULE AND METHOD FOR ITS MANUFACTURE

PRIORITY

This application claims priority to German application no. 103 34 629.5 filed Jul. 29, 2003.

TECHNICAL FIELD OF THE INVENTION

The invention relates to a circuit module with a base unit, with a cover extending over the base unit and with a circuit carrier arranged between the base unit and the cover.

The invention further relates to a method for manufacturing the circuit module.

DESCRIPTION OF THE RELATED ART

These types of circuit modules are generally known and are used in the automotive industry for accommodating transmission and engine control systems. Where possible the known circuit modules are constructed in such a way as to shield the electronic transmission or engine control located on them from their dusty and vibration-prone environment.

To manufacture the known circuit modules the electronic transmission or engine controls are constructed on a circuit board designed as a circuit carrier and the circuit board is fitted to the base unit. The base unit is usually a metal plate into which holes are made for connectors and fixings such as rivets or screws. After the circuit board has been placed on the base unit the circuit board is riveted or screwed to the base unit. In a further step in the procedure the cover is then placed over the circuit board to cover it. The cover itself in its turn has been riveted or screwed to the base plate.

Riveting or screwing the cover and the circuit board to the base unit is a long-winded process and thus involves high costs.

SUMMARY OF THE INVENTION

Using this prior art as a starting point, the object of the invention is to create a simple-to-install circuit module. A further object of the invention is to specify a method of manufacturing the circuit module.

These objects can be achieved by a circuit module comprising a base unit, a cover extending over the base unit, and a circuit carrier arranged between base unit and cover, wherein the cover and the base unit are connected by a pivot joint formed by inserting cover and base unit into each other to form an axis of rotation extending along the base unit and wherein the cover in its assembled state is prevented by at least one retaining means from movement in one direction of rotation around the axis of rotation and from relative movement along the axis or rotation of the pivot joint with regard to the base unit.

The objects can also be achieved by a base unit for a circuit module, wherein the base unit is suitable for a circuit module which further comprises a cover extending over the base unit and a circuit carrier arranged between base unit and cover, wherein the base unit is connectable with the cover by a pivot joint formed by inserting cover and base unit into each other to form an axis of rotation extending along the base unit and wherein the cover in its assembled state is prevented by at least one retaining means from movement in one direction of rotation around the axis of rotation and from relative movement along the axis or rotation of the pivot joint with regard to the base unit.

The objects can furthermore be achieved by a cover for a circuit module, wherein the cover is suitable for a circuit module which further comprises a base unit, wherein the cover extends over the base unit and a circuit carrier arranged between base unit and cover, wherein the cover is connectable with the base unit by a pivot joint formed by inserting cover and base unit into each other to form an axis of rotation extending along the base unit and wherein the cover in its assembled state is prevented by at least one retaining means from movement in one direction of rotation around the axis of rotation and from relative movement along the axis or rotation of the pivot joint with regard to the base unit.

The retaining means may effect a tight fit acting in the direction of the axis of rotation. The retaining means can be an apron of the cover extending at least partly over the side surface of the base unit and transverse to the axis of rotation. The pivot joint may be formed by a hook strip introduced into an encapsulated pivot slot. The base unit can be manufactured from an extruded profile. Cutouts can be embodied in the base unit for attachment means. The cover can be provided with spring strips to hold down the circuit board. The cover can be provided with bending means for clamping the cover to the base unit. The cover may feature a receptacle for a contact element connected to the circuit carrier.

The objects can also be achieved by a method for manufacturing a circuit module in which a circuit carrier is accommodated between a base unit and a cover and the base unit and the cover are attached to each other, comprising the steps of:

- forming a pivot joint between cover and base unit by inserting cover and base unit into each other, and
- after insertion of the circuit carrier, bringing the base unit and the cover into a position relative to each other by a pivoting movement around the axis of rotation of the pivot joint, in which, by at least one retaining means a rotational movement of the cover around the axis of rotation and a relative movement between base unit and cover running along the axis of rotation of the pivot joint is prevented.

The pivot joint may be effected by twisting a hook cross into an encapsulated pivot slot.

With the circuit module the cover is supported on the base unit by a hinged joint enabling it to pivot. This type of hinged joint can easily be produced for example by engaging a tab within a slot. After the circuit carrier has been put into position between base plate and cover the cover can be swung into the position corresponding to the installed state. In this position relative movement between the cover and the base unit in the direction of the axis of rotation of the pivot joint is prevented by using a retaining means. The cover is thus fixed in the direction of the axis or rotation by the retaining means. The cover can also not move transversely to the axis of rotation of the pivot joint since the cover is prevented from moving in this direction by the pivot joint itself. Since no movement of the cover around the axis of rotation is thus possible in the assembled state the cover can also not move out of its assembled position. Thus the cover and the base unit are fixed in their position relative to one another. Since no screws or just a few screws or rivets are required to attach the cover to the base plate, the process of manufacturing the circuit module is simple and cost effective.

In a preferred embodiment of the circuit module the relative movement between the base plate and retaining means which prevents the cover from moving is a tight fit between the base plate and the cover. The advantage of this embodiment is that no screws or rivets are necessary to attach the cover to the base plate.

The base unit is preferably an extruded base plate featuring an encapsulated slot running in the direction of pressing, into which a hook strip of the cover can be introduced. The hook strip is supported so that it can pivot in the guide slot. The encapsulated guide slot can be embodied in such as way that the cover is also held with hardly any play in the transverse direction to the axis of rotation. Thus, despite its simple construction, a pivot joint of this type exhibits all the required functions.

In a further preferred embodiment a cutout for a contact element is provided in the cover with which the circuit carrier establishes electrical contact. There is preferably a tight fit between the cover and the contact element which prevents any movement of the contact element relative to the cover. It is thus possible to dispense with rigidly attaching the contact element to the circuit carrier and to further reduce the costs of assembling the circuit module.

With a further preferred embodiment spring tongues are provided in the cover which exert a spring force on the circuit carrier in the assembled state, through which the circuit carrier is held down inside the circuit module. Thus advantageously no further screw connection between the base unit and the circuit carrier is required to fix the circuit carrier in the circuit module.

BRIEF DESCRIPTION OF THE DRAWINGS

Further features and advantages of the invention can be taken from the description below, in which the invention is described in detail on the basis of the enclosed drawing. The diagrams show:

An exemplary embodiment of a circuit module 1 is now explained on the basis of FIGS. 1 and 2. FIG. 1 here shows a partly cut away perspective view of circuit module 1. FIG. 2 shows the circuit module 1 from FIG. 1 in an exploded view.

DETAILED DESCRIPTION OF THE PREFERRED EMBODIMENTS

Figure 1:
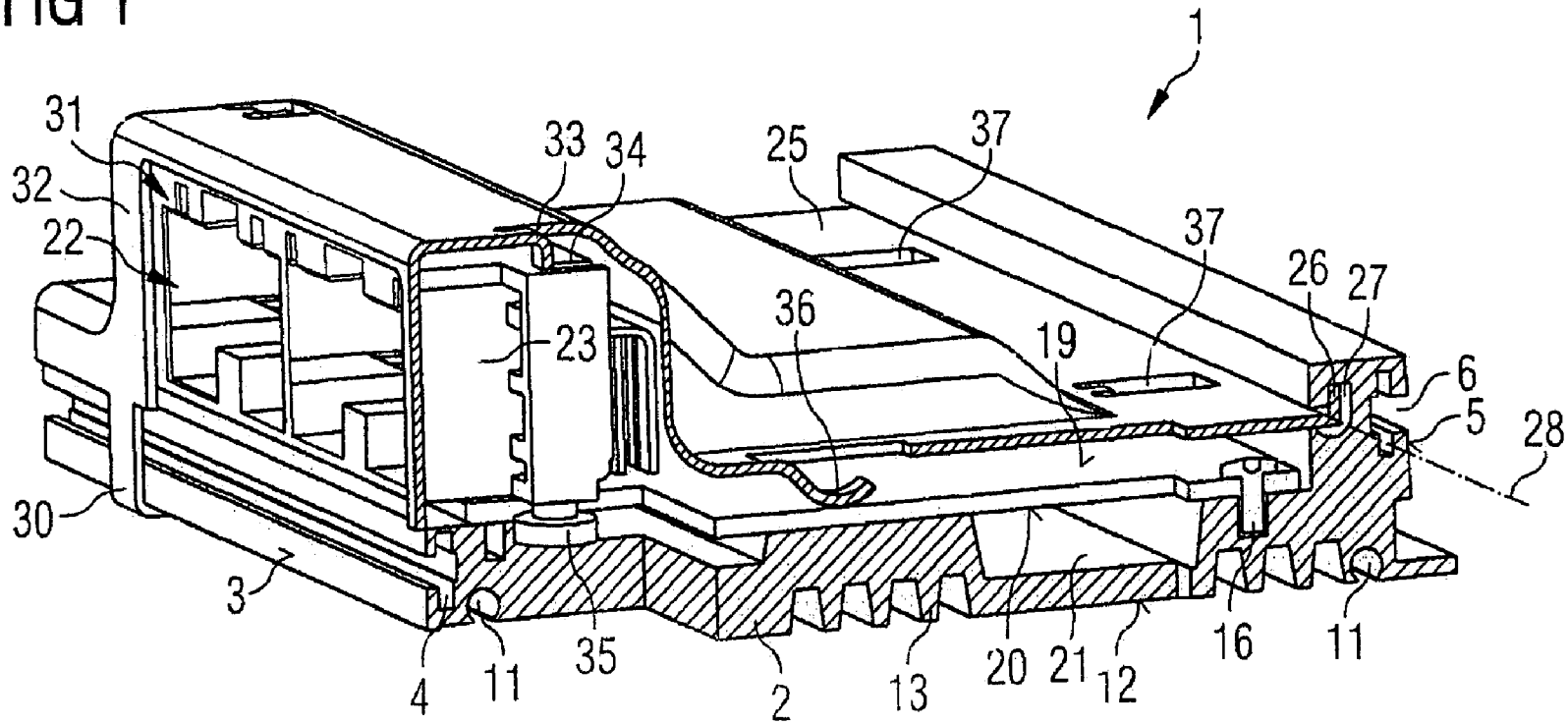
FIG. 1 a partly cutaway perspective view of a circuit module.

Circuit module 1 comprises a base plate 2 with a retaining slot 4 at the front 3 and a retaining slot 6 at the rear 5. Screws 7 with precisely fitting screw heads 9 and 10 can be introduced into slots 4 and 6 to attach the base plate 2 to the inside of a vehicle.

Furthermore the base plate 2 has holes extending in the direction of extrusion 11 into which self-tapping screws can be screwed to attach the base plate 2 to the inside of a vehicle.

In addition cooling fins 13 are formed on the underside 12 of base plate 2 which serve to dissipate the heat generated inside the circuit module.

Screw slots 15 are formed in the top 14 of base plate into which, as shown in FIG. 1 fixing screws 16 can be screwed. The fixing screws 16 can be used to attach a circuit board 17 to the base plate 2. As is explained in more detail below it is also possible to dispense with the fixing screws 16.

Figure 2:
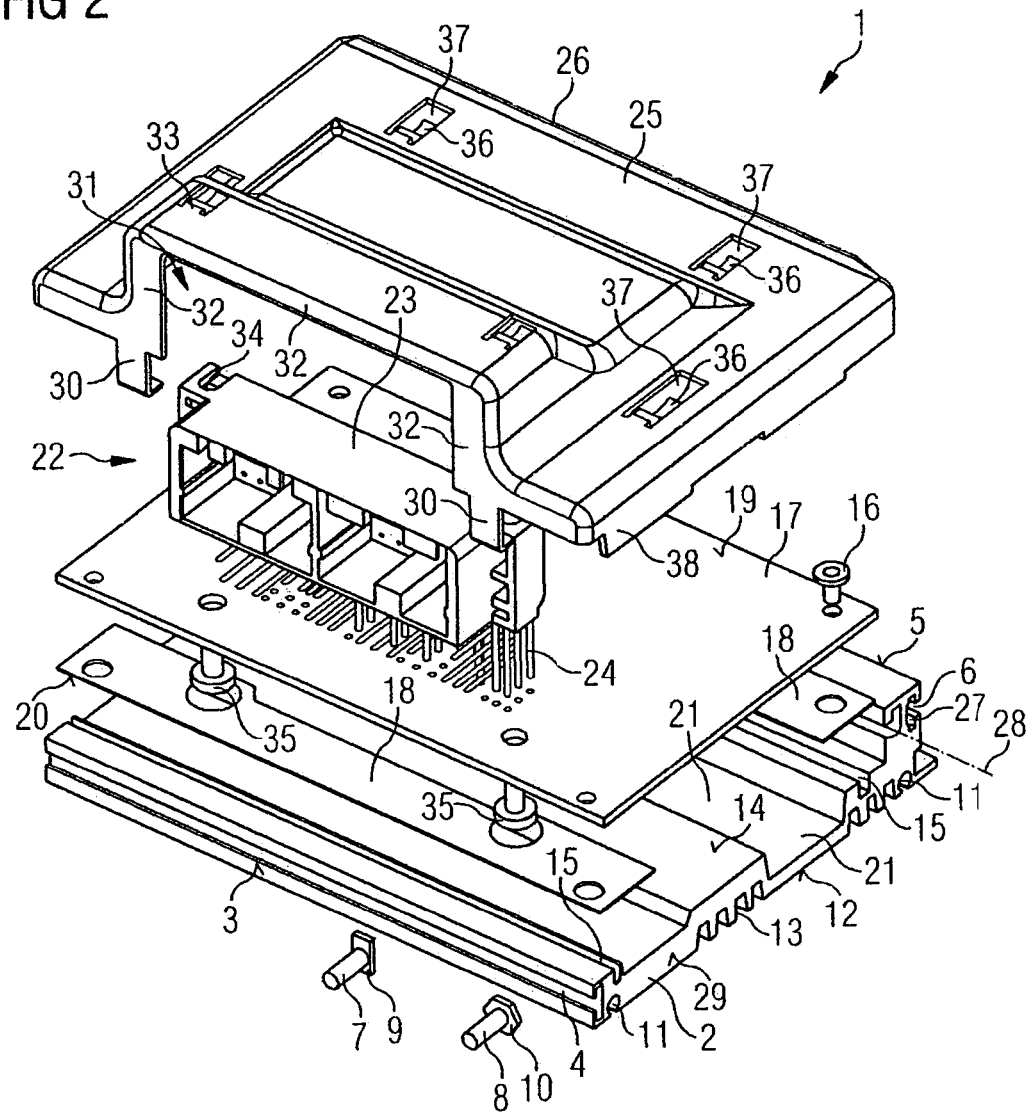
FIG. 2 an exploded view of the circuit module from FIG. 1.

To isolate the circuit board 17 from the base plate 2, insulating strips 18 of electrically insulating material are arranged, as shown in FIG. 2, between the circuit board 17 and the base plate 2.

On the circuit board 17 are components not shown in the Figures. These components can be accommodated both on the top 19 and on the bottom 20 of the circuit board 17. To make it possible to fit components to the bottom 20 of the circuit board 17 a sink 21 is formed into base plate 2. In addition to the components not shown, a connector 22 is also attached to circuit board 17, comprising a connector housing 23 and contact pins 24.

The connector 22 and the circuit board 17 are covered in the assembled state by a cover 25 of which a hook strip 26 engages in an encapsulated pivot slot 27. The hook strip 26 and the pivot slot 27 embodied in the base plate are designed so that the cover 25 can be pivoted around an axis of rotation 28. Depending on the construction of the pivot slot 27 and the hook strip 26, the position of the axis of rotation 28 can depend on the opening angle between base plate 2 and cover 25.

To assemble the cover 25 the hook strip 26 is either pushed into the pivot slot 27 from a side face 29 or introduced into the pivot slot 27 by a combined insertion and twisting movement. After the circuit board 17 has been inserted the cover 25 can then be hinged down onto the base plate 2 and firmly secured to the base plate 2 with the aid of flanging tabs 30. The flanging tabs 30 press the cover 25 down onto the connector 22 so that the circuit board 17 lies securely on the base plate 2 in the area of connector 22.

In the area of a connector opening 31 the cover 25 has edge tabs 32 through which the connector 22 is held back. In addition connector retaining tongues 33 are embodied in the cover 25 in the area of the connector 22 which engage with the allocated cutouts 34 at the rear of the connector housing 23.

Through the flanging tabs 30, the edge tabs 32 and the connector retaining tongues 33 a firm connection is achieved between the connector housing 23 of the connector 22 and the circuit board 17. Basically it is thus possible to dispense with a fixed connection between the circuit board 17 and the connector housing 23. In particular it is possible to dispense with screws 35 with which, in the exemplary embodiment shown in FIGS. 1 and 2, the connector housing 23 is attached to the circuit board 17.

To fix the circuit board 17 within the circuit module 1, spring tongues 36 are punched into the cover 25, of which the number and spatial embodiment depends on the force required to press the circuit board 17 onto the base plate 2. Since the cover 25 is supported on opposite sides by the pivot joint 27 and the connector housing 23, the cover 25 cannot be moved in relation to the circuit board 17 in the assembled state. Consequently the spring pressure operating on the circuit board 17 does not change even if pressure is exerted on the cover 25.

It should be pointed out that the openings 37 produced when the spring tongues 36 are punched out can be covered with the aid of self-adhesive aluminum tape in order to seal the circuit module 1.

To prevent the cover 25 moving along the axis of rotation 28, the cover 25 is provided with side aprons 38 which in the assembled state extend at least partly over the side faces 29 of the base plate 2. The makes any relative movement between cover 25 and base plate 2 in the direction of the axis of rotation 28 impossible. Since on the other hand a movement of the cover 25 in a direction transverse to the axis of rotation 28 is prevented by the pivot slot 27 and the flanging tags 30, the cover 25 is tightly fitted to the base plate 2 to form a secure unit. Since the cover 25 also keeps the connector housing 23 firmly in place, any movement of the circuit board 17 on the top 14 of the base plate 2 is suppressed.

Figure 3:
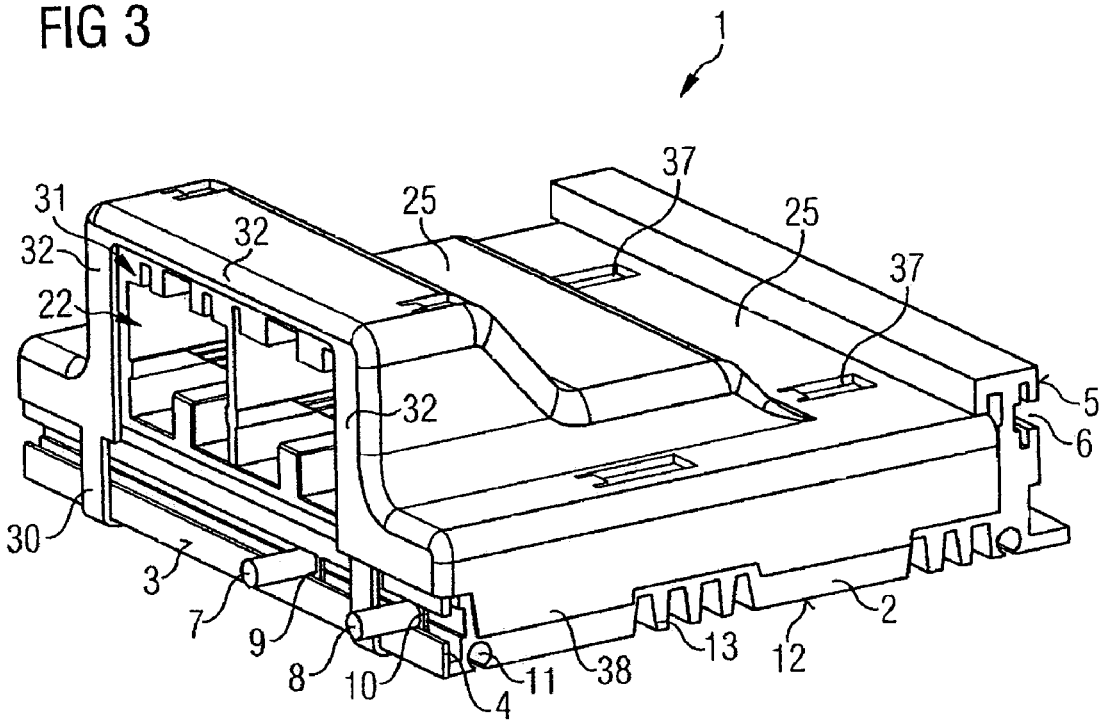
FIG. 3 a further perspective view of the assembled circuit module from FIGS. 1 and 2.

FIG. 3 shows a perspective view of the assembled circuit module 1. FIG. 3 clearly shows that the aprons 38 extend over the side faces 29 of the base plate 2.

To manufacture the circuit module 1 an extrusion process is initially used to produce an extruded pressing which features the cross-sectional profile of the base plate 2. Subsequently the base plate 2 is separated from the extruded pressing. The base plate can also be manufactured in a press and bend process. The cover 25 can for example be manufactured by deep drawing from a steel sheet.

In a further step the equipped circuit board 17 and the insulating strips 18 are fitted to the base plate 2 and the cover 25 is connected to the base plate 2 by twisting the hook strip 26 into the pivot slot 27. The cover 25 can then be hinged downwards until the cover comes to rest on the connector 22. Subsequently the flanges 30 are deformed such that their ends locate on the underside of the base plate 2. This allows the cover 25 to be attached to the base plate 2 without any further securing means such as screws or rivets. The circuit module 1 can thus be assembled in an especially simple and cost effective way.

In a modified assembly procedure the circuit board 17 is first inserted into the inverted cover 25 where the connector retaining tongues 33 of the cover 25 are introduced into the cutouts 34 of the connector housing 23. Through the connector retaining tongues 33 which engage in the cutouts 34 of the connector housing 23 the circuit board 17 is aligned in the cover 25. Subsequently the base plate 2 is attached to the cover 25 by inserting the hook strip 26 into the pivot slot 27 and hinging the base plate 2 down onto the cover 25.

Instead of flanges 30, snap-lock connectors can also be used which engage in retaining slot 4 for example.

Figure 4:
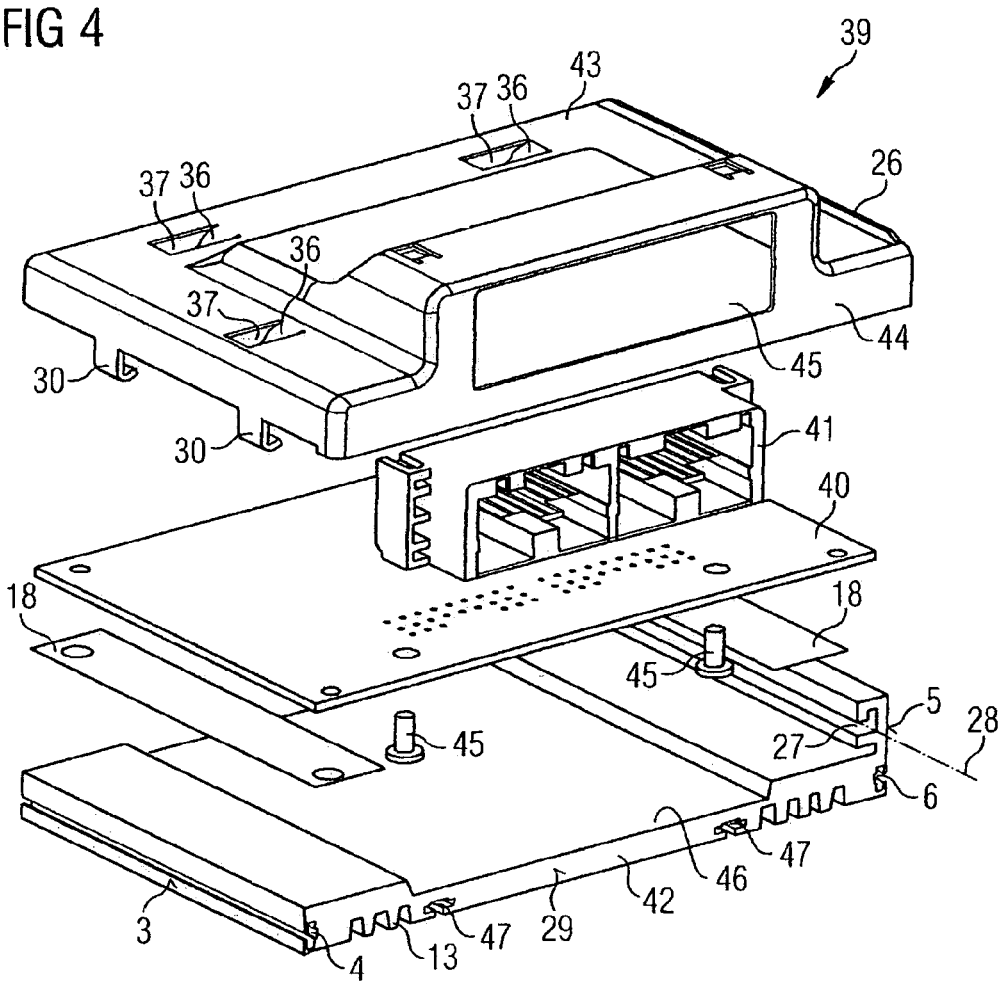
FIG. 4 an exploded view of a further modified circuit module.

FIG. 4 finally shows an exploded view of a further circuit module 39 with a modified circuit board 40 to which a connector 41 can be attached. The connector 41, by contrast with the connector 22 of the circuit module 1 shown in FIGS. 1 to 3, is turned through 90° and extends along the side face 29 of a base plate 42. To cover the base plate 42 and the circuit board 40 arranged on it, a cover 43 is used, modified according to the orientation of connector 41. Thus the cover 43 features an apron 44 in the area of the side face 29 through which a window 45 is formed in cover 43 for the connector 41.

Finally, on the bottom of the base plate 42 there are retaining slots 47 provided, which, like the retaining slots 4 and 6 of the exemplary embodiment shown in FIGS. 1 to 3, are embodied to accommodate screw heads or other means of attachment.

The circuit module shown in FIG. 4 has the advantage that the screws 45 required to attach the connector 41 to the circuit board 40 are located in the area of a sink 46 which ensures that there is a sufficient gap between the base plate 42 and the circuit board 40, especially between the base plate 42 and the contact pins of the components accommodated on the circuit board 40. There is now sufficient space in the sink 46 for the screw heads of the screws 45.

I claim:

1. A circuit module comprising a base unit, a cover extending over the base unit, and a circuit carrier arranged between base unit and cover, wherein the cover and the base unit are connected by a pivot joint formed by inserting cover and base unit into each other to form an axis of rotation extending along the base unit and wherein the cover in its assembled state is prevented by at least one retaining means from movement in one direction of rotation around the axis of rotation and from relative movement along the axis of rotation of the pivot joint with regard to the base unit and wherein the pivot joint is formed by a hook strip introduced into an encapsulated pivot slot.

2. The circuit module in accordance with claim 1, wherein the retaining means effect a tight fit acting in the direction of the axis of rotation.

3. The circuit module in accordance with claim 1, wherein the retaining means is an apron of the cover extending at least partly over the side surface of the base unit and transverse to the axis of rotation.

4. The circuit module in accordance with claim 1, wherein the base unit is manufactured from an extruded profile.

5. The circuit module in accordance with claim 1, wherein Cutouts are embodied in the base unit for attachment means.

6. The circuit module in accordance with claim 1, wherein the cover is provided with spring strips to hold down the circuit board.

7. The circuit module in accordance with claim 1, wherein the cover is provided with bending means for clamping the cover to the base unit.

8. The circuit module in accordance with claim 1, wherein the cover features a receptacle for a contact element connected to the circuit carrier.

* * * * *